United States Patent [19]

Brettschneider et al.

[11] 4,100,897

[45] Jul. 18, 1978

[54] APPARATUS FOR REGULATING THE FUEL-AIR MIXTURE DELIVERED TO AN INTERNAL COMBUSTION ENGINE

[75] Inventors: Johannes Brettschneider, Ludwigsburg; Gerhard Bertling, Vaihingen; Hans Georg Zeller, Grafenau, all of Fed. Rep. of Germany

[73] Assignee: Robert Bosch GmbH, Stuttgart, Fed. Rep. of Germany

[21] Appl. No.: 737,978

[22] Filed: Nov. 2, 1976

[30] Foreign Application Priority Data

Nov. 21, 1975 [DE] Fed. Rep. of Germany ..... 2552207

[51] Int. Cl.[2] ..... F02B 33/00; F02D 35/00

[52] U.S. Cl. ..... 123/119 EC; 123/139 AV; 123/119 R; 123/123; 261/36 A; 261/50 A

[58] Field of Search ..... 123/119 R, 119 E, 119 EC, 123/139 AV, 139 AW, 123, 32 EE; 261/36 A, 50 A; 60/276

[56] References Cited

U.S. PATENT DOCUMENTS

| | | | |
|---|---|---|---|
| 1,982,049 | 11/1934 | Fageol | 123/119 R |
| 2,584,911 | 2/1952 | Orr, Jr. | 123/119 R |
| 2,610,044 | 9/1952 | Wirth et al. | 123/119 R |
| 2,617,397 | 11/1952 | Wirth et al. | 123/119 R |
| 3,768,259 | 10/1973 | Carnahan | 60/276 |
| 3,900,012 | 8/1975 | Wahl | 123/32 EE |
| 3,911,884 | 10/1975 | Moriya et al. | 123/119 EC |
| 4,023,357 | 5/1977 | Masaki | 123/119 EC |

FOREIGN PATENT DOCUMENTS

| | | | |
|---|---|---|---|
| 1,441,660 | 7/1976 | United Kingdom | 123/119 EC |

*Primary Examiner*—Wendell E. Burns
*Attorney, Agent, or Firm*—Edwin E. Greigg

[57] ABSTRACT

An apparatus including a carburetor having a fixed venturi is utilized for regulating the fuel-air mixture delivered to an internal combustion engine. The apparatus includes at least one orifice defining structure, a fuel chamber and a throttle device. The throttle device is connected to the fuel chamber and to the orifice defining structure and is fuel actuatable for varying the cross-sectional flow area of the orifice in accordance with parameters characterizing the operational behavior of the engine.

27 Claims, 8 Drawing Figures

APPARATUS FOR REGULATING THE FUEL-AIR MIXTURE DELIVERED TO AN INTERNAL COMBUSTION ENGINE

BACKGROUND OF THE INVENTION

The present invention relates to an apparatus for the regulation of the fuel-air mixture delivered to an internal combustion engine by the variation of those cross-sectional areas of a carburetor, having a fixed venturi, which influence the fuel apportionment in accordance with parameters characterizing the operational behavior of the internal combustion engine.

In a well-known apparatus of this kind, one or several bypass conduits which can be opened or closed by an electromagnetic valve are provided in parallel with the main fuel orifice of a carburetor fixture. The opening occurs by means of pulses of fixed frequency and differing duration, whereby these given durations of the opened state are variable in accordance with operational parameters of the internal combustion engine.

An apparatus wherein the fuel apportioning section can be supplied through electrically switched valves with fuel having differing pressure levels is also well known. In this apparatus, float chambers featuring differing filling heights serve as the fuel supply source.

These apparatuses entail the disadvantage that the apportioned fuel flow variations take place abruptly. An integration of the fluctuations of the apportioned fuel quantity caused by the constantly changing regulation amplitude, in the sense of an analog variation of this apportioned quantity, which process avoids the strong fluctuations caused by spurious influences, is impossible with these devices. In addition, in the last apparatus described, only a small pressure difference is available for the regulation interaction, so that the desired quantitative variation can be accomplished only relatively slowly.

In addition, in well-known regulation devices the air pressure in the float chamber of a carburetor is regulated by means of connecting the air space of the float chamber alternately with pressure sources of a respectively higher or lower pressure level. The pressures utilized herein are the air pressure respectively in the suction tube upstream of the venturi, and that within the most constricted cross-sectional area of the venturi of the carburetor. This arrangement entails the disadvantage that the available pressures are subject to pulsations, and also that the pressure levels, i.e., the available pressure differences, are dependent upon the given operational condition of the internal combustion engine. Moreover, air is a compressible medium, which, if used as a transmitting link, can easily break into oscillations, so that regulation carried on in this manner can be influenced derogatorily, and supplemental measures must be taken to prevent these oscillations, i.e., to compensate for these influences.

OBJECTS AND SUMMARY OF THE INVENTION

It is, therefore, a principal object of the present invention to provide the existing state-of-the-art with an apparatus with which a multiplicative and a reliably performing regulation of the composition of the fuel-air mixture of the internal combustion engine may be achieved with simple means, whereby the disadvantages described above are avoided, and wherein a regulation process, having good integration characteristics, and being easily correlated to the given requirements, is made possible.

This object is achieved by the fact that the crosssectional areas are variable by means of a fuel actuated throttle apparatus. The use of fuel as the transposing medium possesses the advantage that a stable actuation not susceptible to disturbances and to oscillations of the positioning components, may be accomplished, and through whose interpositioning a favorable and integrating regulation process having a multiplicative interaction with the fuel quantity delivered to the internal combustion engine is achieved.

One embodiment of the apparatus according to the invention has a carburetor with a float chamber, and includes a throttle apparatus which possesses an adjustable positioning element which closes a pressure chamber, which element is subjected to a restoring force. The pressure chamber is subjected, via a connecting line, to the fuel pressure prevalent at the float chamber outlet of the carburetor, which fuel pressure may be substituted completely or partially by another fuel pressure of a preferably higher pressure level, by means of a switching device actuated in accordance with operational parameters.

In a further embodiment of the invention, the pressure in the supply line of a fuel supply pump serves as the substitute pressure. In this manner, with the resultant sufficiently large pressure difference, a stable and rapid adjustment of the throttle device, and an integrating regulation process that is independent of the particular given operational condition of the internal combustion engine may be achieved. This regulation interaction is multiplicative, since the regulation interacts with cross-sectional areas of the carburetor, which directly affect the quantity in the apportionment of the fuel. A further advantage consists in the fact that no additional expenditure is necessary to furnish the differing fuel pressure used in the regulation process, which fact renders this apparatus especially simple.

In a still further embodiment of the invention, an orifice needle serves as the throttle device. With this orifice needle, the cross-sectional area of the main fuel orifice and/or the idle fuel orifice, the cross-sectional area of a fuel bypass orifice bypassing the main fuel orifice, or the cross-sectional area of the idle air orifice and/or of the idle air correction orifice, may be adjusted.

In another embodiment of the invention, a spring loaded preliminary throttle flap valve, located in the suction tube of the cross-sectional region of the venturi, serves as the throttle device.

The invention will be better understood as well as other objects and advantages thereof become more apparent from the following detailed description of the invention taken in conjunction with the drawing.

DESCRIPTION OF THE PREFERRED EMBODIMENTS

Figure 1:
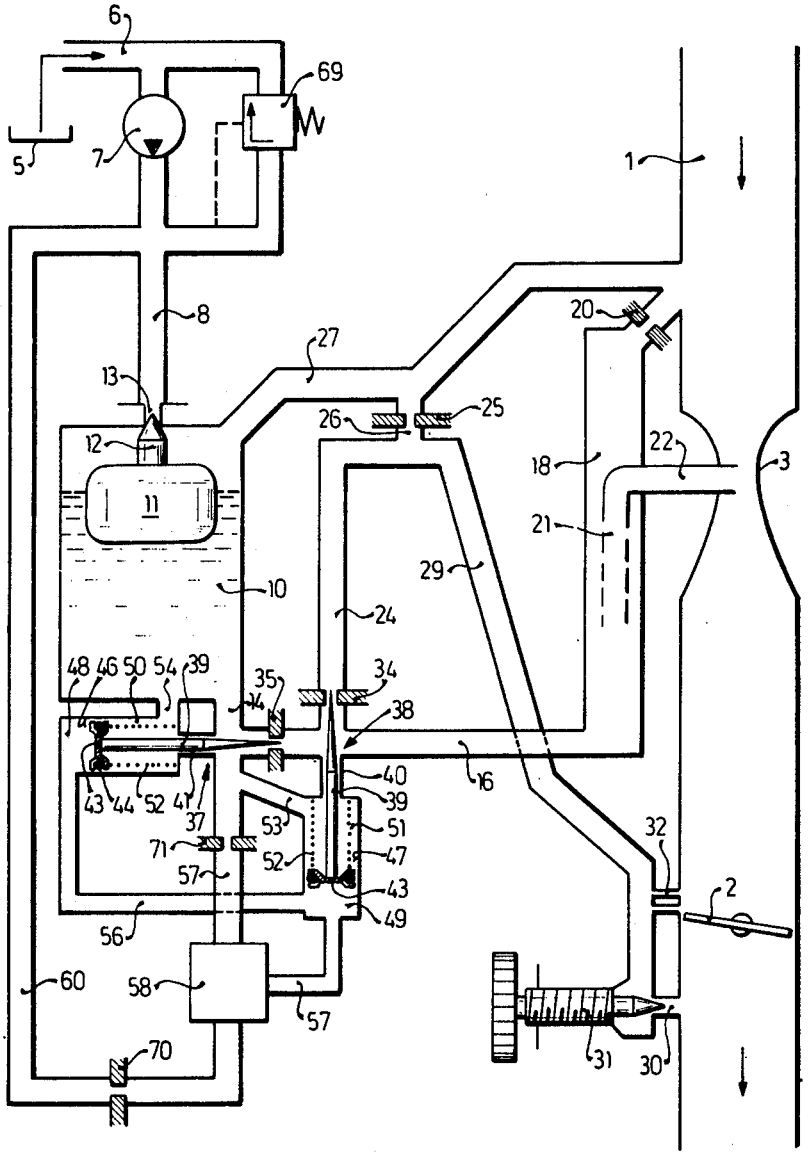
FIG. 1 illustrates a first exemplary embodiment of the apparatus according to the present invention. Included are a carburetor, two throttling devices and a switching device.

FIG. 1 illustrates a first exemplary embodiment of the apparatus according to the invention, including a carburetor of conventional construction, traversed by a portion of a suction tube 1 of an internal combustion engine (not further shown). The suction tube 1 contains, in a conventional manner, an arbitrarily manipulatable throttle flap valve 2 and a venturi constriction 3. The fuel is delivered to the carburetor by a fuel supply pump 7, which sucks the fuel from a storage container 5 via the suction line 6. The fuel is delivered by the pump 7 through a supply line 8 to a float chamber 10 containing a float 11. The float 11 includes a needle-valve 12 which controls an entrance 13 of the supply line into the float chamber, thereby ensuring a constant height of the fuel fill level in the float chamber.

The float chamber 10 has an outlet 14. From the float chamber outlet 14 at the deepest point in the float chamber, a fuel line 16 branches off and enters a standpipe 18. The standpipe 18 communicates, in a conventional manner, with the suction tube 1 upstream of the venturi 13 via an air correction orifice 20. The standpipe 18 further contains, in a conventional manner, a mixing tube 21, from which a fuel ejection pipe 22 protrudes into the most constricted cross section of the venturi 3.

Further branching off the fuel line 16 is a standpipe 24, from whose highest point, lying above the fuel level, a connecting line 26 leads to a vent line 27. The connecting line 26 includes an idle air orifice 25. The vent line 27 connects the air space of the float chamber 10 with the suction tube 1 upstream of the venturi 3. A continuing branch line 29 of the standpipe 24 leads downward, and enters the suction tube 1 downstream of the throttle flap valve 2 via a bore 30. The bore 30 is controlled by an idle regulating screw 31. In addition, transition bores 32 branch off from the line 29 and communicate within the swept region of the throttle flap valve 2, directly upstream of its closed attitude, with the suction tube 1.

For dosing of the fuel flow, the standpipe 24 contains an idle fuel orifice 34, and the fuel line 16 contains a main fuel orifice 35 between its junction with the standpipe 24 and the float chamber. Thus far the carburetor described corresponds to one of conventional construction. According to the present invention, a throttle device 37 is provided for the main fuel orifice 35, and a throttle device 38 for the idle fuel orifice 34. These throttle devices each consist, respectively, of a needle valve 39, which protrudes into the jet opening of the main fuel orifice, respectively of the idle fuel orifice. The needle valves are guided respectively in a bore 40, 41 and include at their opposite and tail end a dish-shaped portion 43, acting as a positioning element, which possesses on its periphery a ring gasket 44. The ring gasket 44 glides within a respective bore 46, 47 coaxially disposed relative to the orifice opening, and separates these bores respectively into a pressure chamber 48, 49 and a working chamber 50, 51. The working chambers 50 and 51 each contain a spring 52 coaxially disposed relative to the needle valve 39. The spring 52 expands between the respective dish-shaped portion 43 and a face of the working chamber 50, 51. The springs 52 tend to move the respective needle valve in an opening sense, i.e., in a sense tending to open the orifice opening. The working chambers 50 and 51 are respectively connected to the outlet of the float chamber via passages 54 and 53, so that the pressure prevailing within the working chambers 50 and 51 is equal to the float chamber pressure. The pressure chambers 48 and 49 communicate with each other via a line 56. From the pressure chamber 49, a connecting line 57 further leads, through a switching device 58 and line 57, to the fuel line 16 and outlet 14. The switching device 58 will be more fully described with reference to the several configurations depicted in FIGS. 2–5. A pressure line 60 branches off from the supply line 8 and leads to the switching device 58 and the connecting line 57.

Figure 2:
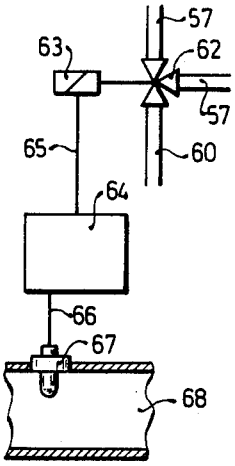
FIGS. 2–5 illustrate various embodiments of the switching device of the embodiment of FIG. 1 and associated structure.

According to the configuration illustrated in FIG. 2, the switching device consists of a three-way valve 62 actuatable by an electromagnet 63. The electromagnet 63 is connected, via a line 65, to a regulator 64, which receives its control signal via a line 66 from a known exhaust gas measuring probe 67, for example, an oxygen measuring sensor. This measuring probe is located, in a well-known manner, within a part 68 of the exhaust system of the engine. The probe 67 determines, in a known manner, the composition of the exhaust gases relative, for example, to their oxygen content. As soon as an oxygen surplus exists, or a certain $\lambda$ value is deviated from, either upward or downward, then the oxygen probe sends a threshold-value signal potential to the regulator 64, which converts it to a corresponding positioning signal. Depending upon the design of the regulator, the three-way valve can be keyed in a keying ratio corresponding to the given regulation magnitude of the oxygen measuring sensor, or the valve can be actuated by an analog signal again corresponding to the regulation magnitude. Such regulators are well known, and need not here be described in greater detail.

The regulating is not confined to the use of the signal from an oxygen measuring sensor, as described above with respect to FIG. 2. In a corresponding manner, other parameters that characterize the operational behavior of the internal combustion engine can also be utilized in the controlling process. For example, the dynamic stability of the internal combustion engine is a potential factor. In a well-known embodiment featuring this method, a detector determines the distribution of the pressure patterns in the combustion chambers. In a similar manner, variations in the turning moment of inertia of the crankshaft of the engine, or fluctuations in the revolutions per unit time, may serve as the desired signal. In addition, it has been further proposed to influence the regulation of the fuel-air mixture by means of ion current measurements within the combustion chamber of the combustion engine. This regulation process, as well as other methods for the determination of the composition of the exhaust gases, such as, for example, temperature measurements, can be utilized herein.

The above described arrangement according to FIG. 1, and in conjunction with FIG. 2, operates as follows:

The given air quantity aspirated past the throttle flap valve 2 and determined by the rpm of the engine, is gauged by the resulting subpressure established within the venturi 3, which subpressure causes a correspondingly lesser or greater outflow of fuel from the fuel ejection pipe 22. In a familiar manner, air may additionally be introduced by means of the air correction orifice via the mixing tube 21 and the fuel ejection pipe 22. This well known function need not be elaborated upon herein. In a similar manner, when the internal combustion engine is running and the throttle flap valve 2 is closed, air is aspirated through the bypass via the idle air orifice 25 and fuel is simultaneously conveyed through the idle fuel orifice 34. The fuel-air mixture delivered to the internal combustion engine in this manner is determined by the given setting of the air regulating screw 31. The given maximum fuel quantity introduced during idle, and during the full-load state, is determined by the given cross section of the passage in the idle fuel orifice 34 and in the main fuel orifice 35, respectively. Depending upon the given size of this cross-sectional area, for example at the main fuel orifice, the fuel flow is throttled to a greater or lesser extens so that, for any given pressure condition at the venturi 3, more or less, respectively, fuel can be introduced into the suction tube 1.

By means of the throttle devices 37 and 38, a variation of the cross-sectional area of the orifices, and therewith of the apportioned fuel quantity, is made possible for any given operational condition (rpm and throttle flap position). So long as the pressure chambers 48 and 49 are connected to the outlet of the float chamber 10 via the connecting line 57 by means of the switching device 58, the two sides of the dish-shaped portion 43 are acted upon by equal pressures. Hence, the spring 52 moves the needle valve 39 away from its respective orifice, so that the respective opening remains un-throttled. When, on the other hand, the pressure chambers 48 and 49 are connected, for example, via the three-way valve 62 with the pressure line 60, then the higher pump discharge pressure comes to bear in these pressure chambers, causing the needle valve 39 to move in the direction of the orifice, until an equalization of the forces takes place at the dish-shaped portion 43 between the spring force and the force resulting from the hydraulic pressures. When the three-way valve 62 is being positioned by an analog signal, a specific desired pressure-mix corresponding to the given regulation valve, i.e., to the given operational behavior of the internal combustion engine, can be maintained within the pressure chambers 48 and 49 with the aid of a particular corresponding intermediate positioning of the valve. The same result can also be achieved with a keyed switching of the three-way valve, in the sense of a continuous alternation of the connection of the pressure chambers 48 and 49 once to the float chamber, and once to the pressure line 60. The given respective opening durations are therein shifted, in accordance with the operational behavior of the internal combustion engine, through the regulator 64, in correspondence with the regulation signal, by favoring either the pressure source having the higher pressure level or the pressure source having the lower pressure level.

In order to achieve a constant working pressure in the pressure line 60, a further configuration can include the provision of a pressure-limiting valve within a bypass around the fuel supply pump 7.

In the apparatus presently under consideration, two very constant pressures are thus available for the creation of the desired pressure-mix within the pressure chambers 48 and 49, so that a very precise and only minimally disturbance-prone regulation of the cross-sectional areas of the main fuel orifice and of the idle fuel orifice can be accomplished. Furthermore, to obtain a good integration behavior, a throttle 70 can be located in the pressure line 60, and a throttle 71 in the connecting line 57 between the switching device 58 and the float chamber outlet 14. The cross-sectional areas of these throttles, which throttles may, for example, also be replaced by corresponding diminutively dimensioned connecting lines, are herein fitted to the available volumes of the pressure chambers 48 and 49, as well as to the output pressures.

Figure 3:
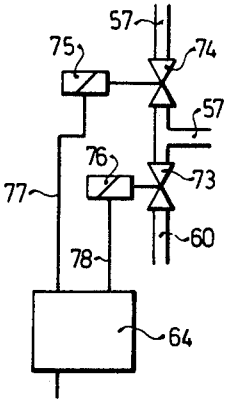

FIG. 3 illustrates a further configuration of the switching device 58. Here the pressure line 60 leading into the connecting line 57 contains a switch valve 73, and the connecting line 57 contains a valve 74 between its junction with the pressure line 60 and the float chamber outlet 14. Both valves are actuatable by means of the electromagnets 75 and 76, which are linked to the regulator 64 via the lines 77 and 78. By means of the regulator 64, the valves 73 and 74 can be oppositely keyed, and controlled with an openedstate ratio per unit time which varies in accordance with the control amplitude of the given utilized operational parameter. This relationship can also be described as the keying ratio, i.e., the relative duration of acuation is described by the keying ratio.

Figure 4:
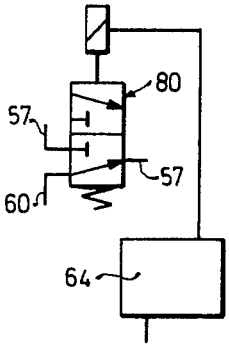

FIG. 4 illustrates an alternative to the exemplary embodiment according to FIG. 2. Here the pressure line 60 branching off from the connecting line 57 contains an electomagnetic switch-valve 80. The switch-valve 80 is controlled in a corresponding manner, and with a variable keying ratio, by the regulator 64.

Figure 5:
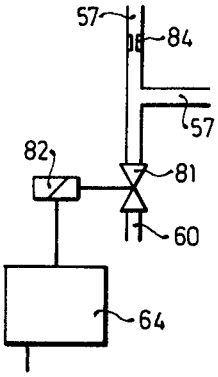

FIG. 5 shows a switching device containing only one valve 81 in the pressure line 60. This valve is similarly actuatable by a regulator 64 via an electromagnet 82. Between its junction with the pressure line 60 and with the float chamber outlet 14, the connecting line 57 further contains a throttle 84, which bears directly upon conditions at the valve 81, and which, hence, is dimensioned in consideration of these special conditions. The valve 81 may be either keyed, or else actuated by an analog signal, from a correspondingly constructed regulator.

Figure 6:
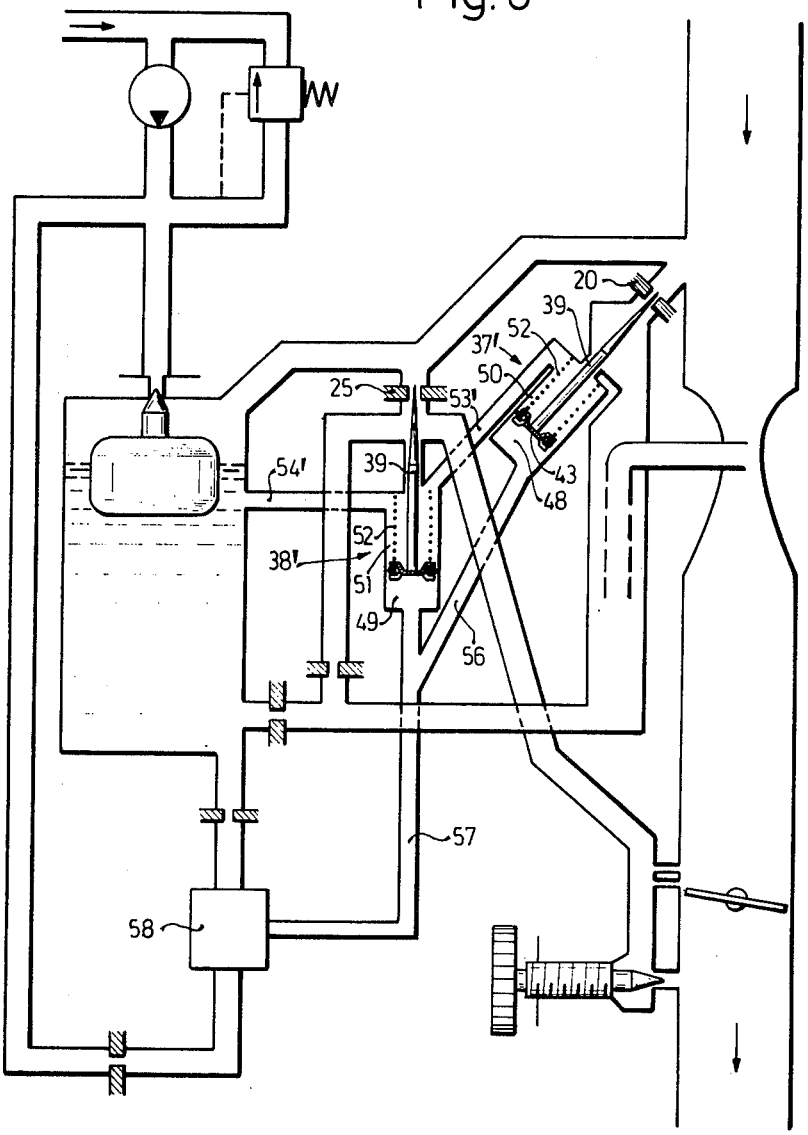

The exemplary embodiment according to FIG. 6 is constructed substantially like the exemplary embodiment according to FIG. 1, to which reference is accordingly made in the following description. Departing from the exemplary embodiment according to FIG. 1, however, here the throttle devices 37' and 38' are not deployed with the main fuel orifice and the idle fuel orifice, but rather with the air correction orifice 20 and with the idle air orifice 25. Here these similarly constructed throttle devices are likewise oriented coaxially relative to the axis of the orifice bore, and consist respectively of a needle valve 39 having a dish-shaped portion 43 acted upon on one side by the pressure spring 52, and exposed on the other side to the hydraulic pressure conducted to the pressure chambers 48 and 49 via the switching device 58, the connecting line 57, and the line 56. The working chambers 50 and 51 communicate with the float chamber via the lines 53' and 54'.

The apportioned fuel quantity may also be varied for any given operational requirements (revolutions per unit time and throttle flap valve position) by the analogous means of the alteration of the cross-sectional area of the idle air orifice or of the air correction orifice 20, as it can by means of the alteration of the fuel-apportioning orifices of the carburetor. The desired interaction proceeds as in the exemplary embodiment according to FIG. 1. Through the appropriate control of the switching device 58 by the regulator, a pressure corresponding to the given operational behavior of the internal combustion engine is established in the pressure chambers 49 and 48. To this given pressure corresponds a certain definite displacement of the needle valve 39 i.e., a certain particular cross-sectional area of the two given orifices. Naturally, depending upon the given size of the associated internal combustion engine, or upon any special demands, the regulation interaction may also be effected at just one of the fuel orifices, or at the idle air orifice, or at the air correction orifice. The same holds true relative to the exemplary embodiment according to FIG. 1, wherein the modulation of the cross-sectional area of either the main fuel orifice alone, or of the idle fuel orifice alone, can be similarly effected. There, too, it is sensible, for example with internal combustion engines of moderate output, to confine the interaction to the main fuel orifice. For relatively large engines, interaction at the cross-sectional area of the idle orifice may be important, especially in the case of an independent idle, i.e., in the case where the fuel for the idle system is obtained directly from the float chamber, or obtained between the float chamber and the main orifice, but not downstream of the main orifice.

In place of the illustrated embodiment of the positioning member of the throttle needle valve in the form of a dish-shaped portion, which is provided with a peripheral seal, such other embodiments as, for example, pistons, roll membranes, or simple membranes can, of course, also be employed as the positioning agent.

Figure 7:
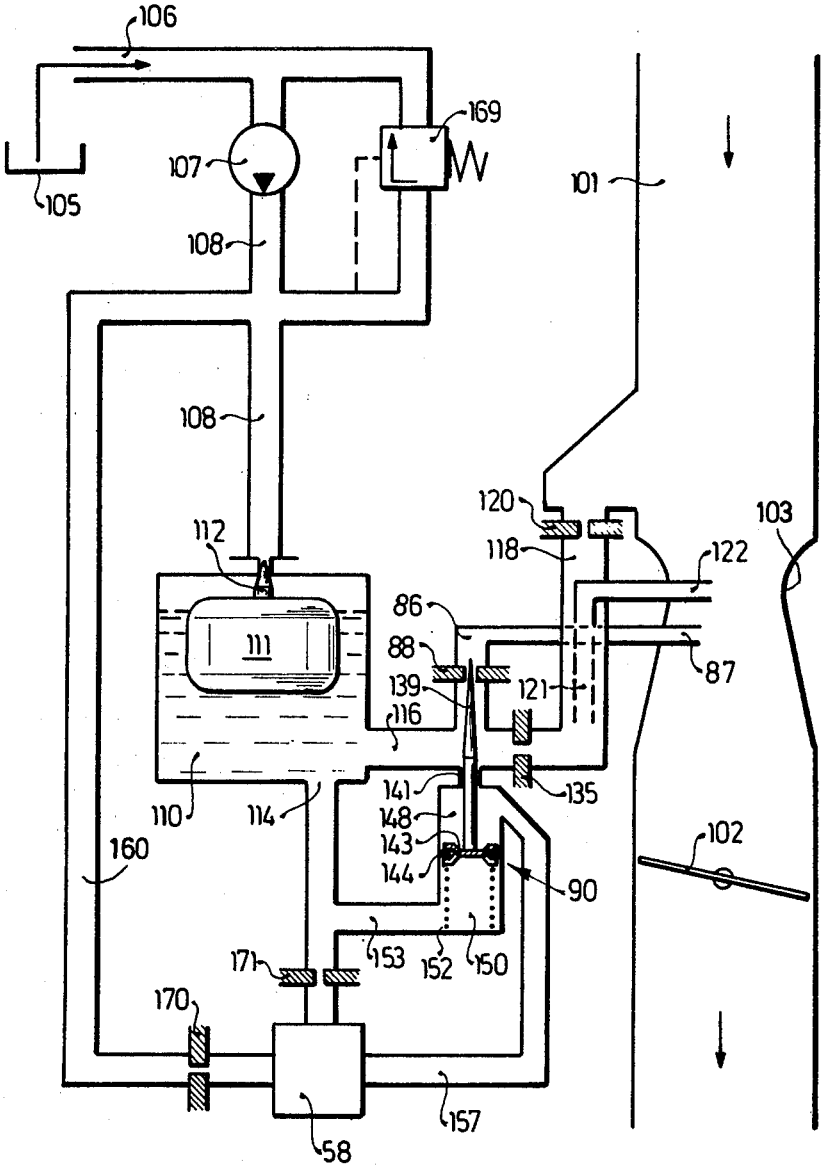

FIG. 7 illustrates a further form of the embodiment of the invention, wherein a cross-sectional area of a bypass around the main fuel orifice is being regulated. As in the preceding exemplary embodiment, the present embodiment represents a carburetor of conventional construction, having a suction tube 101 containing a venturi 103 and downstream thereof an arbitrarily manipulatable throttle flap valve 102. The fuel is supplied to the carburetor in a like manner by means of the fuel supply pump 107, which sucks fuel from a fuel container 105 via a suction line 106, delivering it to a float chamber 110 via the supply line 108. A bypass around the fuel supply pump 107 contains a pressure-limiting valve 169, which opens the communication between the supply line 108 and the suction line 106 whenever a certain pressure is extended.

The entrance of the supply line 108 into the float chamber 110 is controlled by a needle valve 112 of a float 111, which determines the surface level of the fuel within the float chamber. From the base of the float chamber 110, a fuel line 116 branches off and leads to a standpipe 118. The standpipe 118 communicates with the suction tube 101 upstream of the venturi 103 via the air correction orifice 120. The standpipe 118 contains a mixing tube 121, which conducts the fuel mixed with the air to a fuel ejection pipe 122 in the most constricted cross section of the venturi 103, as a result of the subpressure developed at the venturi. The fuel line 116 further contains the main fuel orifice 135, which determines the given fuel flow for the differing operational conditions of the internal combustion engine.

Thus far the carburetor described herein also corresponds to a conventional carburetor, as it was also described in the exemplary embodiments according to FIGS. 1 and 6. For the sake of simplification, the idle system was omitted in this drawing. Departing from the conventional carburetor construction, in the present configuration according to the invention, a further fuel line 86 branches off from the fuel line 116, and becomes an ejection pipe 87 protruding into the venturi 103. The ejection pipe 87 lies directly downstream of the ejection pipe 122, and on a level slightly lower than the fuel surface level determined by the float 111. An added bypass fuel orifice 88 is located in the fuel line 86 branching off from the fuel line 116 upstream of the main fuel orifice 135. The cross-sectional area of this orifice is controlled by a needle valve 135 possessing at its tail end a dish-shaped portion 143 serving as the positioning member. In a similar configuration as for the throttle devices 37 and 38, a throttling device 90 carries the needle valve 139 coaxially relative to the bore of the bypass fuel orifice 88. The dish-shaped portion 143 possesses on its periphery a ring gasket 144 which glides tightly within a cylindrical chamber, so that the chamber is separated into a pressure chamber 148 and a working chamber 150. Furthermore, the needle valve 139 is guided in a close-fitting bore 141.

The pressure chamber 148 located on the side of the dish-shaped portion 143 facing the point of the needle valve 139, communicates with the outlet 114 of the float chamber 110 via a line 157. The opposing working chamber 150 contains a pressure spring 152 which tends to move the dish-shaped portion 143 together with the needle valve 139 in the sense of a reduction of the cross-sectional area of the orifice 88. The working chamber 150 further communicates with the outlet 114 of the float chamber 110 via the line 153 so that as long as the connection via the connecting line 157 is not interrupted, the hydraulic forces acting upon the dish-shaped portion 143 are equalized, and the needle valve 139 is held, under the constraint of the pressure spring 152, in that position which closes the orifice bore. In the absence of hydraulic pressure, no fuel can therefore flow via the fuel ejection pipe 87, which lies beneath the fuel surface level in the float chamber.

As in the preceding exemplary embodiments, the connecting line 157 contains a switching device 58, which can be constructed according to the embodiments of FIGS. 2–5. Here too, a pressure line 160 branches off from the supply line 108 and leads to the connecting line 157. Thus, either the pressure in the float chamber 110 or the discharge pressure of the fuel supply pump can be alternatingly conducted to the pressure chamber 148 via the switching device 58, thereby establishing a presssure mix, in accordance with the given operational behavior of the internal combustion engine, which pressure mix lies between the cited maximal pressures. To enhance the integration behavior, here too the pressure line 160 contains a throttle 180, and the connecting line 157 contains a throttle 171 between the switching device 58 and the float chamber outlet 116.

The operation of the apparatus is essentially analogous to the previously described exemplary embodiments. To the air-throughput dependent fuel quantity introduced via the fuel ejection pipe 122, further throughput dependent fuel is additionally introduced in a like manner via the ejection pipe 87, except that this fuel quantity is variable, by means of the alteration of the cross-sectional area of the fuel bypass orifice 88, in accordance with the operational behavior of the internal combustion engine. Because the outlet of the ejection pipe 87 lies beneath the fuel surface level in the float chamber 110, the regulation interaction achieved by means of the modulation of the cross-sectional area of the fuel bypass orifice remains effective throughout the entire throughput-range. When the internal combustion engine is not running, i.e., when the regulation is not functional, the fuel bypass orifice 88 is closed by the needle valve 139 under the action of the pressure spring 152. This condition may, of course, also occur within certain extreme operational regions of the internal combustion engine.

Figure 8:
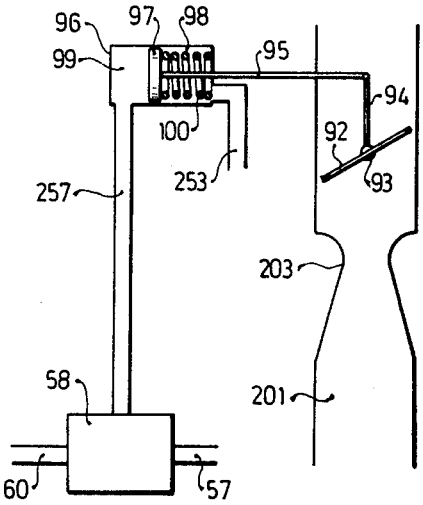
FIGS. 6–8 illustrate a second, third and fourth exemplary embodiment of the apparatus according to the present invention. These embodiments illustrate varying configurations of throttling devices.

FIG. 8 depicts a further possible option for the control of a cross-sectional area, by whose alteration the fuel delivery is influenced in a multiplicative mode. Omitting the description of the remaining components of the carburetor, the suction tube 201 contains a preliminary throttle flap valve 92 upstream of the venturi 203 of the carburetor, which preliminary throttle flap valve swings about a shaft 93 through actuation by a lever 94, attached to the shaft 93. The lever 94 is pivotably connected to a piston rod 95 of a piston 97 movable within a hydraulic cylinder 96. The piston 97 separates the hydraulic cylinder into a working chamber 98 and a pressure chamber 99, which can communicate with the float chamber via a line 257 by means of the switching device 58, as is the case in the previously described exemplary embodiments. The piston 97 is acted upon by the spring 100 in the working chamber 98 in such a manner as to move the preliminary throttle flap valve 92 in its opening direction, in the absence of hydraulic pressure. The working chamber 98 further communicates with the float chamber via a line 253, as is the case in the exemplary embodiments according to FIGS. 1, 6 and 7. The apparatus functions in the same manner as in the preceding exemplary embodiments. Corresponding to the given control attitude of the switching device 58 as determined by the regulator 64, the pressure chamber 99 receives a pressure-mix established between the discharge pressure of the fuel supply pump and the float chamber pressure. Depending upon the given pressure-mix, the piston is accordingly displaced against the force of the spring 100, and the suction tube 201 is respectively closed more or less by means of the preliminary throttle flap valve. The increase of the vacuum resulting therefrom yields a corresponding increase in the delivered fuel quantity in the venturi 203. This interaction is also multiplicative, and it can be realized by simple means.

What is claimed is:

1. In an apparatus for regulating the fuel-air mixture delivered to an internal combustion engine including: a carburetor having a fixed venturi; a fuel chamber; at least one orifice defining means; at least one throttle device connected to the fuel chamber and the orifice defining means, and actuated by a variable fuel pressure for varying the cross-sectional flow area of the orifice defining means and thereby influencing the fuel-air mixture in accordance with parameters characterizing the operational behavior of the engine.

2. The apparatus as defined in claim 1, further including: connecting line means; and a switching device, wherein the fuel chamber comprises a float chamber having an outlet connected to each fuel actuated throttle device by the connecting line means, wherein each throttle device includes a movable positioning element, a pressure chamber subjected to the pressure existing at the float chamber outlet which is communicated to the pressure chamber by the connecting line means, means exerting a restoring force to the movable positioning element, said restoring force acting to close the pressure chamber, and wherein the switching device is connected to the connecting line means and to another pressure source, said switching device being actuated by the operational parameters of the engine for controlling the pressure within the pressure chamber of each throttle device such that the pressure in the pressure chamber of each throttle device is any combination of the pressure at the float chamber outlet and the other pressure source, said other pressure source being preferably higher than the pressure existing at the float chamber outlet.

3. The apparatus as defined in claim 2, further including: a fuel supply pump; and a fuel supply line connected to the fuel supply pump and the float chamber, wherein the other pressure source is the pressure within the fuel supply line.

4. The apparatus as defined in claim 3, further including: a pressure limiting valve, wherein the pressure limiting valve is connected to the fuel supply line.

5. The apparatus as defined in claim 3, further including: a pressure line connected to the fuel supply line and the connecting line means, wherein the cross-sectional area of the pressure line is variable by the switching device.

6. The apparatus as defined in claim 3, further including: a pressure line connected to the fuel supply line and the connecting line means, wherein the cross-sectional area of the connecting line means in the region between its junction with the pressure line and the float chamber is variable by the switching device.

7. The apparatus as defined in claim 3, further including: a pressure line connected to the fuel supply line and the connecting line means, wherein the cross-sectional area of the pressure line and the connecting line means in the region between its junction with the pressure line and the float chamber is variable by the switching device.

8. The apparatus as defined in claim 1, wherein the orifice defining means defines a main fuel orifice having a spring loaded needle valve assembly associated therewith to control the cross section thereof, and wherein the needle valve assembly serves as the fuel actuated throttle device.

9. The apparatus as defined in claim 1, wherein the orifice defining means defines an idle fuel orifice having a spring loaded needle valve assembly associated therewith to control the cross section thereof, and wherein the needle valve assembly serves as the fuel actuated throttle device.

10. The apparatus as defined in claim 1, wherein a main fuel orifice and an idle fuel orifice are provided each with a spring loaded needle valve assembly associated therewith to control the cross section thereof, and wherein the needle valve assemblies serve as fuel actuated throttle devices.

11. The apparatus as defined in claim 1, wherein the orifice defining means defines a fuel bypass orifice having a spring loaded needle valve assembly associated therewith to control the cross section thereof, and wherein the needle valve assembly serves as the fuel actuated throttle device.

12. The apparatus as defined in claim 11, further including: a main fuel orifice; a fuel ejection pipe leading from the main fuel orifice into the venturi; and a further fuel ejection pipe connected to the fuel bypass orifice and extending into the venturi directly downstream of the fuel ejection pipe and below the fuel surface level of the fuel in the fuel chamber.

13. The apparatus as defined in claim 2, wherein the orifice defining means defines a fuel bypass orifice having a spring loaded needle valve assembly associated therewith to control the cross section thereof, and wherein the needle valve assembly serves as the fuel actuated throttle device, said needle valve assembly including a needle valve and a pressure spring which exerts the restoring force against the movable positioning element to move it in the closing direction of the needle valve.

14. The apparatus as defined in claim 1, wherein the orifice defining means defines an idle air orifice having a spring loaded needle valve assembly associated therewith to control the cross section thereof, and wherein the needle valve assembly serves as the fuel actuated throttle device.

15. The apparatus as defined in claim 1, wherein the orifice defining means defines an idle air correction orifice having a spring loaded needle valve assembly associated therewith to control the cross section thereof, and wherein the needle valve assembly serves as the fuel actuated throttle device.

16. The apparatus as defined in claim 1, wherein an idle air orifice and an idle air correction orifice are provided each with a spring loaded needle valve assembly associated therewith to control the cross-section thereof, and wherein the needle valve assemblies serve as fuel actuated throttle devices.

17. The apparatus as defined in claim 1, further including: an induction tube; a throttle flap valve; and spring loaded control means connected to the throttle flap valve, wherein the fixed venturi is located within the induction tube, wherein the throttle flap valve is located within the induction tube upstream of the venturi, wherein the induction tube and the throttle flap valve comprise the orifice defining means, and wherein the spring loaded control means serves as the fuel actuated throttle device.

18. The apparatus as defined in claim 2, further including: a regulator connected to the switching device, wherein the switching device comprises at least one electrically actuatable switch valve which is actuatable between an opened and a closed position by the regulator in a keying ratio corresponding to the regulating value of an operational parameter of the engine.

19. The apparatus as defined in claim 18, further including: a fuel supply pump; a fuel supply line connected to the fuel supply pump and the float chamber; and a pressure line connected to the fuel supply line and the connecting line means; wherein the switching device comprises two switch-valves which are respectively located in the pressure line and in the connecting line means between its junction with the pressure line and the float chamber, and wherein the two switch-valves are connected to the regulator and are actuatable and oppositely keyed by the regulator.

20. The apparatus as defined in claim 18, further including: a fuel supply pump; a fuel supply line connected to the fuel supply pump and the float chamber; and a pressure line connected to the fuel supply line and the connecting line means, wherein the switching device comprises a switchvalve located at the junction of the pressure line and the connecting line means.

21. The apparatus as defined in claim 18, further including: a fuel supply pump; a fuel supply line connected to the fuel supply pump and the float chamber; a pressure line connected to the fuel supply line and the connecting line means; and a throttle, wherein the switching device comprises a valve in the pressure line, and wherein the throttle is included in the connecting line means between its junction with the pressure line and the float chamber.

22. The apparatus as defined in claim 2, further comprising: a regulator, and wherein the switching device comprises at least one electromagnetically actuatable valve, whose cross-sectional area is continuously variable by the regulator in accordance with the regulating value of an operational parameter of the engine.

23. The apparatus as defined in claim 21, further including: a fuel supply pump; a fuel supply line connected to the fuel supply pump and the float chamber; and a pressure line connected to the fuel supply line and the connecting line means, wherein the switching device comprises a threeway valve located at the junction of the pressure line and the connecting line means.

24. The apparatus as defined in claim 2, further including: a fuel supply pump; a fuel supply line connected to the fuel supply pump and the float chamber; a pressure line connected to the fuel supply line and the connecting line means; a throttle located in the pressure line; and a throttle located in the connecting line means, wherein the throttle in the connecting line means is located between the switching device and the float chamber.

25. The apparatus as defined in claim 1, further including: an exhaust gas measuring probe, wherein the signal from the exhaust gas measuring probe serves as the operational parameter.

26. The apparatus as defined in claim 1, wherein the relative dynamic stability of the engine serves as the operational parameter.

27. The apparatus as defined in claim 1, further including: an ion-current probe, wherein the signal from the ion-current probe serves as the operational parameter.

* * * * *